US008434792B2

(12) United States Patent
Martineck, Sr.

(10) Patent No.: US 8,434,792 B2
(45) Date of Patent: May 7, 2013

(54) METHOD FOR FACILITATING A MULTI-LINGUAL GAME

(75) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 268 days.

(21) Appl. No.: 12/873,849

(22) Filed: Sep. 1, 2010

(65) Prior Publication Data

US 2012/0049507 A1 Mar. 1, 2012

(51) Int. Cl.
*B42D 15/00* (2006.01)

(52) U.S. Cl.
USPC ..... 283/102; 283/901; 283/903

(58) Field of Classification Search ..... 283/102, 283/901, 903; 434/156–185
See application file for complete search history.

(56) References Cited

U.S. PATENT DOCUMENTS

| | | | | |
|---|---|---|---|---|
| 3,918,174 | A * | 11/1975 | Miller et al. | 283/102 |
| 4,734,036 | A * | 3/1988 | Kasha | 283/901 |
| 7,590,950 | B2 | 9/2009 | Collins et al. | |
| 2005/0130736 | A1 | 6/2005 | Polak et al. | |

* cited by examiner

*Primary Examiner* — Dana Ross
*Assistant Examiner* — Kyle Grabowski
(74) *Attorney, Agent, or Firm* — Dority & Manning, P.A.

(57) ABSTRACT

A method for facilitating multi-lingual play of a game on a single game card includes providing a game play area on the game card. A first set of game instructions are provided on the game card printed in a first language. A second set of the game instructions in a different second printed language over superimposed over the first set of game instructions. An indicator is provided on the game card to convey that the first set of game instructions are present and accessible by removing the second set of game instructions. A player has the option to read the game instructions in either or both of the first or second printed languages.

12 Claims, 3 Drawing Sheets

METHOD FOR FACILITATING A MULTI-LINGUAL GAME

FIELD OF THE INVENTION

The present invention generally relates to a method for implementing games played with game cards, such as lottery tickets, and more particularly to a method for facilitating multi-lingual play of such games.

BACKGROUND

"Scratch-off" or "instant-win" lottery tickets have enjoyed immense popularity in the lottery industry for decades. These games offer distinct advantages to the lottery authorities and are attractive to a broad spectrum of players. Typically, the tickets are printed in the primary language of a targeted population base. For example, the same themed ticket may be printed in different runs in English, Spanish, German, and so forth, depending on the intended country or other distribution locale.

However, as the population base grows more culturally diverse, particularly in larger metropolitan areas, one single language may no longer be "dominant" over a broad population spectrum. Entire sections or neighborhoods of a city or other locale may speak one language, while an adjacent neighborhood speaks and entirely different language. The residents of these neighborhoods may not be comfortable with the other respective language. This pertains to play of lottery tickets in differing languages as well. Persons who are not fluent or comfortable with the language of the instant-win lottery ticket may avoid playing the game for fear of not understanding the game rules or, even worse, not recognizing that their ticket may actually be a winning ticket. As the games continue to add more complex value and entertainment features, the reluctance to play by those not comfortable with the language of the ticket will correspondingly grow.

In the past, it has not been economically or commercially feasible to provide a multi-lingual game card or lottery ticket. The available surface area on an instant-win ticket (often referred to as the ticket "real estate") for the various game features, such as a game play area, instructions, security features, graphics, and so forth, is limited and cannot reasonably accommodate repetition of the pertinent game rules or instructions in different languages. Essentially, the only option was to provide separate printing runs of tickets in the different languages.

Accordingly, the industry and public would benefit from the ability to facilitate multi-lingual play of a game on a printed game card, such as an instant-win lottery ticket.

SUMMARY

Objects and advantages of the invention will be set forth in the following description, or may be obvious from the description, or may be learned through practice of the invention. It is intended that the invention include modifications and variations to the system and method embodiments described herein.

In a particular embodiment, a method is provided for facilitating multi-lingual play of a game on a single game card. For example, the method may provide for play of the game in English and Spanish on the same game card. It should be appreciated that the invention is not limited to any particular combination of different languages.

The method includes providing a game play area on the game card that is used in play of the respective game. The type, theme, award, and other game features are not limiting to the invention. A first set of game instructions are provided on the game card printed in a first language, for example Spanish, A second set of the game instructions in a different second printed language, for example English, are superimposed over the first set of game instructions. An indicator, such as graphics or written language, is provided on the game card to indicate that the first set of game instructions are present and accessible by removing the second set of game instructions from over the first set of game instructions. In this manner, a player has the option to read the game instructions in either of the first or second (or both) printed languages.

In a particular embodiment, the first set of game instructions are printed on the game card and subsequently covered by a removable opaque layer (e.g., a scratch-off layer), and the second set of game instructions are printed onto the opaque layer. The indication on the game card instructs the player to remove the opaque layer to reveal the first set of game instructions.

The game card (and associated game) may be embodied as a lottery game ticket, particularly an instant-win lottery ticket wherein a scratch-off layer is provided in the game play area. Removal of this scratch-off layer reveals the outcome of the lottery game. The first set of game instructions printed in the first language may be covered by a second scratch-off layer on the lottery ticket, with the second set of game instructions being printed on the second scratch-off layer. The indicator on the lottery ticket is separated from the second scratch-off layer and instructs a player to remove the second scratch-off layer to reveal the underlying first set of game instructions. The indicator may be printed in the first or second language, or in both languages.

The present invention also encompasses a multi-lingual enabled game card, such as an instant-win lottery ticket, that incorporates various combinations of the features discussed above.

DETAILED DESCRIPTION

Figure 1:
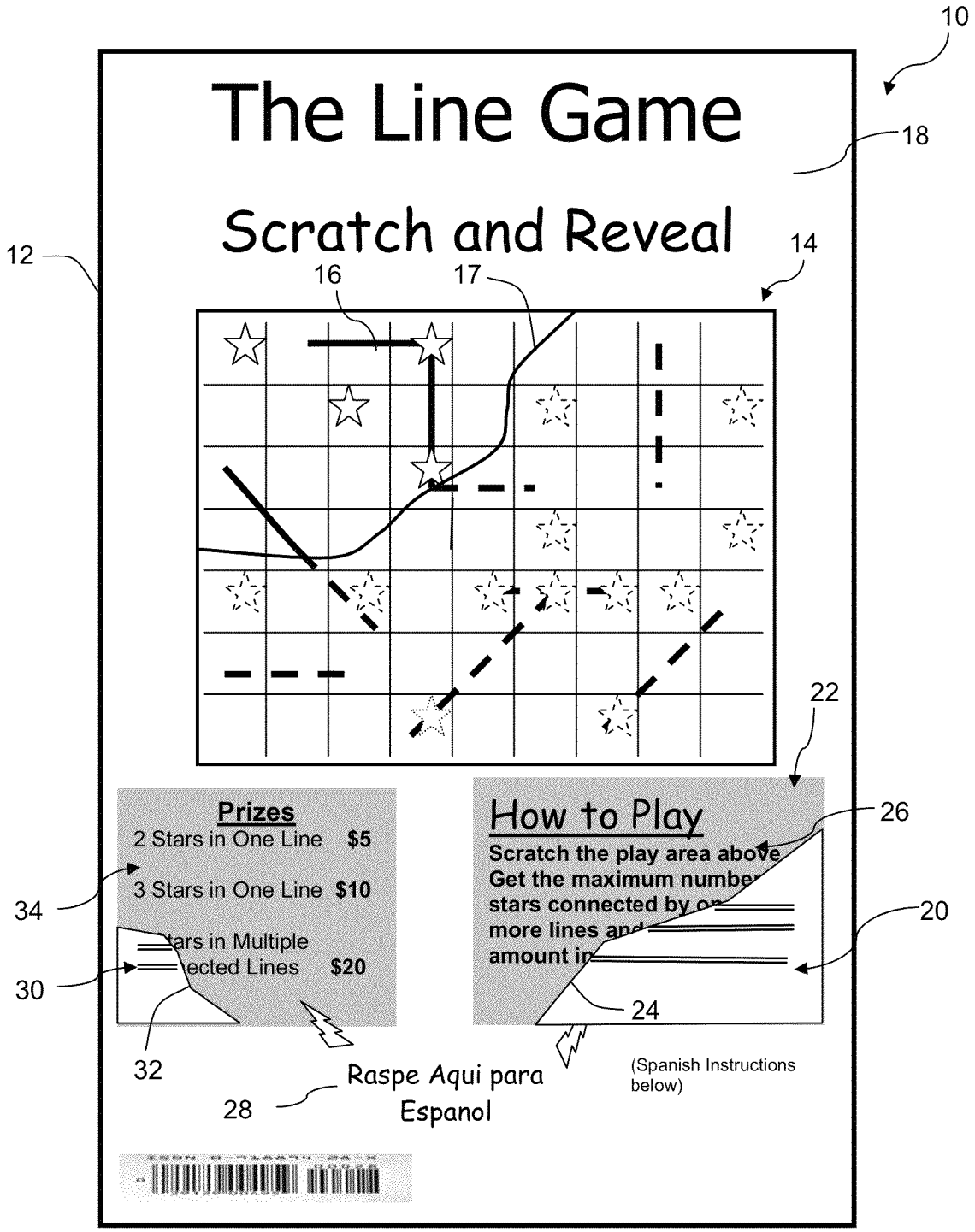
FIG. 1 is a front planar view of an embodiment of a game card in accordance with aspects of the present methodology for providing a multi-lingual game card.

Reference will now be made in detail to certain embodiments of the system and methodology in accordance with aspects of the invention, examples of which are illustrated in the drawings. Each embodiment is provided by way of explanation of the invention, and is not meant as a limitation of the invention. For example, features illustrated and described as part of one embodiment may be used with another embodiment to yield still a further embodiment. It is intended that the present invention include these and other modifications and variations as come within the scope of the appended claims and their equivalents.

Figure 2:
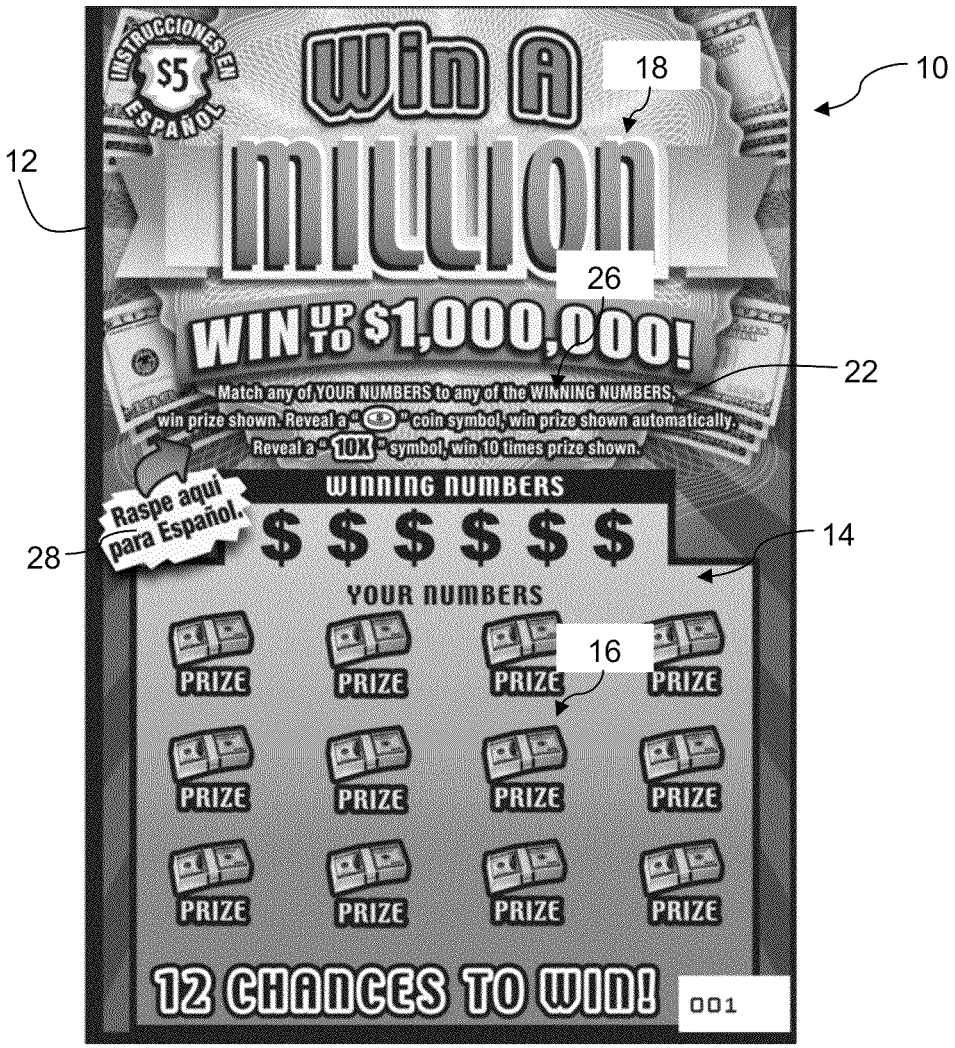
FIG. 2 is a front view of an instant-win lottery ticket produced in accordance with the present method.
Figure 3:
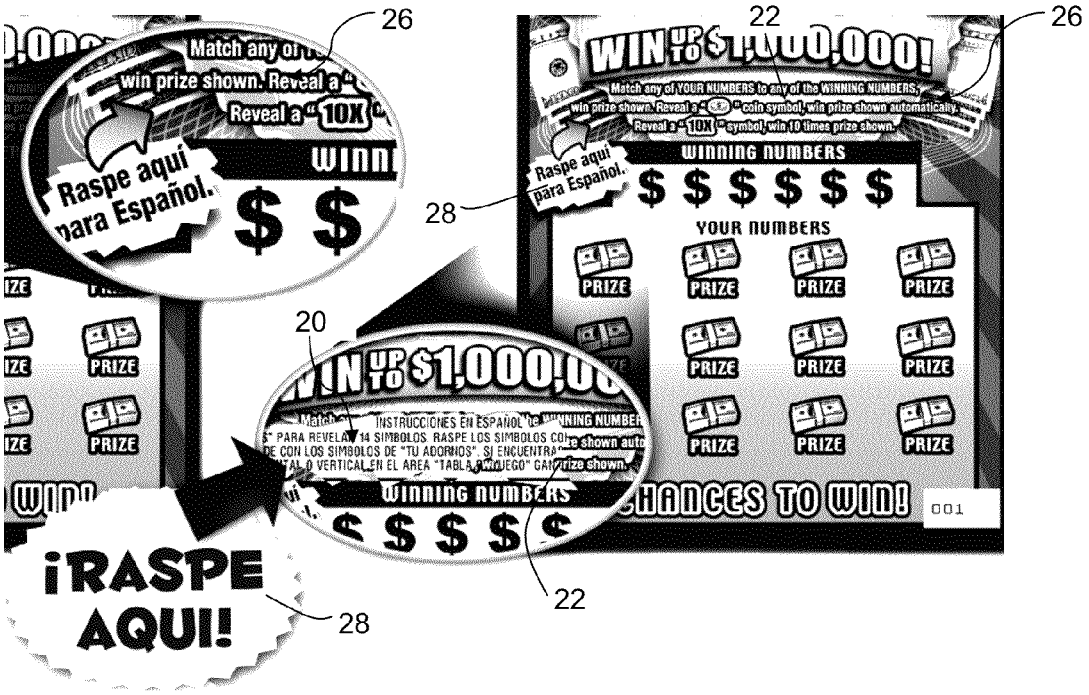
FIG. 3 is an enlarged view of certain features of the lottery ticket of FIG. 2.

FIGS. 1 through 3 represent aspects of the present method for facilitating multi-lingual play of a game on a single game card. For example, referring to FIG. 1, a game card 10 is illustrated. In this particular embodiment, game card 10 is a lottery ticket. However, it should be appreciated that the method and game cards 10 are not limited to lottery tickets, and that the method and cards 10 may be used in any embodiment wherein games are played by players via a card 10 for entertainment or other purposes. The game card 10 includes a substrate 12, which may be any manner of paper stock, or other suitable material. The term "substrate" is used herein to encompass not only the base material, but all manner of printing, coatings, layers, and so forth that are subsequently applied to the base material.

A game play area 14 is provided on the game card 10. The game play area 14 contains any manner of game play indicia 16 related to play of the particular type of game embodied by the game card 10. For example, in the embodiment wherein the game card 10 is a lottery ticket, the game play area 14 may include any manner of indicia 16 related to the lottery game. It should be readily appreciated that the contents of the game play area 14 are not a limiting factor of the present methodology. The game card 10 may also include any manner of indicia 18 related to the theme or other aspect of the game.

The method includes providing a first set of game instructions 20 on the game card 10 that are printed in a first language. For example, the first set of game instructions may be printed in Spanish, whereas the game play indicia 17 and any other indicia 18 on the game card 10 related to the game theme are printed in a different language, for example English.

Referring still to FIG. 1, the present method also includes superimposing a second set of game instructions 26 printed in a different second language, for example English, over the first set of game instructions 20. The second set of game instructions 26 are printed onto a removable covering 22 that is applied over the first set of game instructions 20 prior to printing the second set of game instructions 26. In a particular embodiment, the removable covering 22 may be, for example, an opaque scratch-off layer 24. The formulation and application of such scratch-off layers is well known and widely used in the art. In an alternate embodiment, the second set of game instructions 26 may be printed on the removable covering 22 before the covering 22 is applied over the first set of game instructions. For example, the instructions 26 may be printed onto a peel-off label that is applied over the first set of instructions 20.

An indicator 28 is provided on the game card 10 that conveys to players that a different set of instructions in a different language are present on the card below the visible set of instructions and may be accessed by removing the second set of instructions 26. Referring to FIG. 1, the indicator 28 may be depicted graphically, or in printed language that instructs the player to remove the second set of instructions 26, for example by removing the scratch-off layer 24.

The concept of providing multi-lingual capability to the game card 10 need not be limited to the game instructions. For example, referring to FIG. 1, the game card 10 includes a prize award section wherein a second prize table 34 is printed on a removable scratch-off layer 32. A first prize table 30 underlies the second prize table 34 and is printed in a different language. The prize table 30 is accessible as indicated by the indicator 28 by removing the scratch-off layer 32 containing the first prize table 34.

It should be appreciated that the methodology incorporates various means for superimposing the second set of instructions 26 (and the second prize table 34). For example, in addition to the opaque scratch-off layers discussed above, the removable covering 22 may be a removable tab, peel-off layer, and so forth.

As discussed above, the game card 10 may be implemented as a lottery ticket, particularly an instant-win lottery ticket as depicted in FIG. 1 wherein a different scratch-off layer 17 covers the game play indicia 16. The game instructions 20, 26 provide to the player adequate instruction for removing the scratch-off layer 17 and determining whether or not the lottery ticket is a winning ticket.

The indicator 28 may be provided in the written language that corresponds to the underlying first set of instructions 20. For example, in the embodiment of FIG. 1, the indicator 28 is printed in Spanish so as to inform a Spanish-speaking player that Spanish instructions are provided below the second set of instructions 26. As further indicated in FIG. 1, the method may further include providing an additional indicator (or expanding the existing indicator 28) to indicate in the second language exactly what underlies the removable covering 22. This feature may be desired to prevent curious players from removing the second set of instructions 26 prior to actually playing the game simply to see what is under the scratch-off layer 24. If the player were to remove the instructions 26 in this manner and could not understand the first set of instructions 20, then the player may not be comfortable with continuing the game on the game card 10.

FIGS. 2 and 3 illustrate a more detailed graphic depiction of a game card 10 that may result from the present methodology. The game card 10 is an instant-win lottery ticket that is played by a person removing a scratch-off layer in the game play area 14. The instructions 26 teach the player how to play the game and are printed in English, which is also the language of the game indicia 18. The English language instructions 26 are printed onto a removable scratch-off layer 22. An indicator 28 is written in Spanish and instructs Spanish-speaking players to scratch away the English set of instructions 26 to reveal Spanish instructions. FIG. 3 depicts the various features just described in greater detail.

It should be appreciated that the present invention also encompasses various embodiments of a game card 10, and particular instant-win lottery tickets, incorporating features resulting from the present methodology, as discussed in detail above.

It should be readily appreciated by those skilled in the art that various modifications and variations can be made to the embodiments illustrated and described herein without departing from the scope and spirit of the invention.

What is claimed is:

1. A method for facilitating multi-lingual play of a game on a single game card, comprising:

providing a game play area on the game card;

providing a first set of game instructions on the game card printed in a first language;

superimposing a second set of the game instructions in a different second printed language over the first set of game instructions;

providing an indication on the game card that the first set of instructions are present and accessible by removing the second set of game instructions;

wherein a player has the option to read the game instructions in either of the first or second printed languages; wherein the game is a lottery game and the single card is a scratch-off lottery ticket; and wherein the first set of game instructions are printed on the lottery ticket and subsequently covered by an opaque scratch-off layer, and the set second set of game instructions are printed on the scratch-off layer.

2. The method as in claim 1, wherein the first set of game instructions are printed on the game card and subsequently covered by a removable opaque layer, and the second set of game instructions are printed onto the opaque layer.

3. The method as in claim 2, wherein the indication on the game card instructs the player to remove the opaque layer to reveal the first set of game instructions.

4. The method as in claim 1, wherein the indication on the lottery ticket instructs the player to remove the scratch-off layer to reveal the first set of game instructions.

5. The method as in claim 4, wherein the indication on the lottery ticket is printed in the first language.

6. The method as in claim 5, further comprising providing an indication on the lottery ticket that informs players in the second language as to what underlies the first set of game instructions.

7. The method as in claim 1, further comprising providing game theme indicia on the game card in the second language.

8. A multi-lingual enabled game card, comprising:

a substrate having a game play area provided thereon;

a first set of game instructions provided on the substrate separated from the game play area, the first set of game instructions printed in a first language;

a second set of the game instructions printed in a different second language superimposed over the first set of game instructions;

an indicator on the substrate separated from the first and second set of game instructions indicating that the first set of instructions are present and accessible by removing the second set of game instructions from over the first set of game instructions; and wherein the game card is a scratch-off lottery ticket, the lottery ticket comprising a first scratch-off layer in the game play area for instant play of the lottery game and a second scratch-off layer over the first set of game instructions, the second set of game instructions printed on the second scratch-off layer.

9. The game card as in claim 8, further comprising a removable opaque layer over the first set of game instructions, the second set of game instructions printed on the opaque layer.

10. The game card as in claim 9, wherein the indicator on the game card instructs a player to remove the opaque layer to reveal the first set of game instructions.

11. The game card as in claim 8, wherein the indicator on the lottery ticket is printed in the first language.

12. The game card as in claim 11, further comprising game theme indicia on the game card printed in the second language.

* * * * *